US009082576B2

(12) United States Patent
Nishimura

(10) Patent No.: US 9,082,576 B2
(45) Date of Patent: Jul. 14, 2015

(54) CONTACT DEVICE

(71) Applicant: Panasonic Corporation, Oaska (JP)

(72) Inventor: Tsukasa Nishimura, Hokkaido (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 13/783,964

(22) Filed: Mar. 4, 2013

(65) Prior Publication Data

US 2013/0234811 A1 Sep. 12, 2013

(30) Foreign Application Priority Data

Mar. 9, 2012 (JP) ..... 2012-053066

(51) Int. Cl.

| | |
|---|---|
| ***H01H 3/00*** | (2006.01) |
| ***H01H 50/64*** | (2006.01) |
| ***H01H 1/34*** | (2006.01) |
| ***H01H 50/54*** | (2006.01) |

(52) U.S. Cl.

CPC ..... *H01H 50/643* (2013.01); *H01H 1/34* (2013.01); *H01H 50/546* (2013.01)

(58) Field of Classification Search

CPC ..... H01H 2059/0072; H01H 36/0073; H01H 50/546; H01H 9/34; H01H 50/54

USPC ..... 335/78, 128, 185, 189, 196, 200, 126, 335/131

See application file for complete search history.

(56) References Cited

U.S. PATENT DOCUMENTS

| | | | | |
|---|---|---|---|---|
| 5,892,194 | A * | 4/1999 | Uotome et al. | 218/68 |
| 2002/0036557 | A1 * | 3/2002 | Nakamura et al. | 335/128 |
| 2006/0044090 | A1 * | 3/2006 | Angle et al. | 335/128 |
| 2006/0181376 | A1 * | 8/2006 | Mikl et al. | 335/78 |
| 2009/0237191 | A1 * | 9/2009 | Yano et al. | 335/202 |

FOREIGN PATENT DOCUMENTS

JP 2010-192416 A 9/2010

* cited by examiner

*Primary Examiner* — Bernard Rojas

(74) *Attorney, Agent, or Firm* — McDermott Will & Emery LLP

(57) ABSTRACT

A contact device (1) includes a base (41), a movable contact member (29) stored inside the base (41), and one or more rotation stoppers (50) formed separately from the movable contact member (29) and provided between the movable contact member (29) and the base (41) so as to regulate a rotation of the movable contact member (29). At least one rotation stopper (50) regulates a movement in one rotating direction of the movable contact member (29).

11 Claims, 6 Drawing Sheets

CONTACT DEVICE

CROSS REFERENCE TO RELATED APPLICATION

This application is based upon and claims the benefit of priority from Japanese Patent Application No. 2012-053066, filed on Mar. 9, 2012, the entire contents of which are incorporated herein by reference.

BACKGROUND OF THE INVENTION

The present invention relates to a contact device.

As described in Japanese Patent Unexamined Publication No. 2010-192416, there is known a contact device including a movable contact member provided with movable contact points, a base that houses the movable contact member, and rotation stoppers provided between the movable contact member and the base. The rotation stoppers regulate the rotation of the movable contact member at the point of coming into contact with and separating from fixed contact points.

In Japanese Patent Unexamined Publication No. 2010-192416, the movable contact member is provided with protrusions as the rotation stoppers on each long side. When the movable contact member rotates, the protrusions come into contact with the inner wall of a sealing container which acts as the base, so as to regulate the rotation of the movable contact member. In this case, by bringing only one of the two diagonally opposite corners of a pair of protrusions into contact with the inner wall of the sealing container, it is possible to reduce a friction force between the movable contact member and the inner wall, caused when the movable contact member comes into contact with and separates from the fixed contact points and slides on the inner wall of the sealing container. Accordingly, the movable contact member can move smoothly so that the reliability of a switching action between the contact points is enhanced.

SUMMARY OF THE INVENTION

In the conventional contact device, the protrusion provided on one long side of the movable contact member comes into contact with a long side on the inner wall of the sealing container so as to regulate the rotation of the movable contact member. When an arc, which is generated at the point of contact and separation between the movable contact points and the fixed contact points, is extended, there is sufficient space for expansion of the arc in the longitudinal direction; however, the scope for arc expansion in the width direction is limited.

Therefore, it is an object of the present invention to provide a contact device capable of enabling a movable contact member to move smoothly and ensure enough space for sufficient arc expansion.

In order to solve the conventional problem, a first aspect of the present invention is to provide a contact device comprising: a base; a movable contact member stored inside the base; and at least one rotation stopper formed separately from the movable contact member and provided between the movable contact member and the base so as to regulate a rotation of the movable contact member, the at least one rotation stopper regulating a movement in one rotating direction of the movable contact member.

A second aspect of the present invention is to provide the contact device, wherein the rotation stopper is composed of one member and includes a first contact surface that regulates the movement in one rotating direction of the movable contact member, and a second contact surface that regulates a movement in another rotating direction of the movable contact member.

A third aspect of the present invention is to provide the contact device, wherein the rotation stopper is a protrusion that projects from an inner wall surface of the base.

A fourth aspect of the present invention is to provide the contact device, wherein the rotation stopper is provided on a short side of the inner wall surface of the base opposed to a short side of the movable contact member.

A fifth aspect of the present invention is to provide the contact device, wherein a contact surface of the rotation stopper with the movable contact member is provided perpendicular to the rotating direction of the movable contact member.

According to the present invention, the rotation stoppers that regulate the rotation of the movable contact member are provided between the movable contact member and the base, and are formed separately from the movable contact member. Therefore, the base can be enlarged compared with conventional cases since it is not necessary to bring the movable contact member into contact with the inner wall surface of the base to regulate the rotation of the movable contact member. Further, since the rotation of the movable contact member can be regulated even if the base is enlarged, the space for the arc can be expanded sufficiently not only in the longitudinal direction but also in the width direction of the movable contact member. As a result, the arc generated at the point of contact and separation between the movable contact points and the fixed contact points, can be extended also in the width direction of the movable contact member. Accordingly, an arc extinction capacity (an arc interruption capacity) can be increased.

Further, since at least one of the rotation stoppers regulates the movement of the movable contact member in one rotating direction, it is possible to reduce a friction force between the movable contact member and the rotation stoppers, and enable the movable contact member to move smoothly.

According to the present invention, not only the arc can be interrupted more reliably, but also a friction force at the point of the sliding action of the movable contact member can be reduced. Therefore, the reliability of the contact points can be further enhanced.

BRIEF DESCRIPTION OF THE DRAWINGS

FIG. 1 is an external view of a case of a contact device according to an embodiment of the present invention.

DETAILED DESCRIPTION OF THE PREFERRED EMBODIMENTS

Figure 1A:
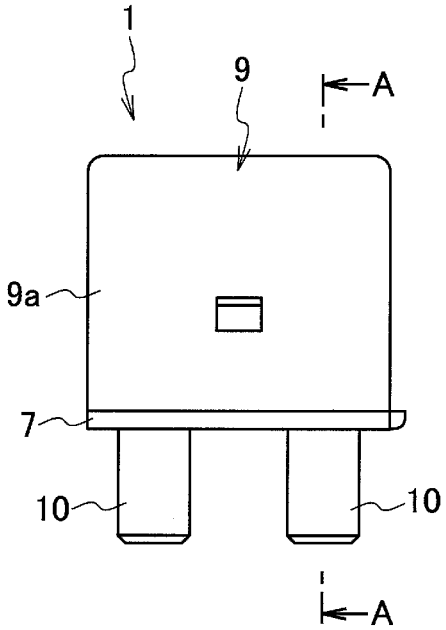
FIG. 1A is a front view.
Figure 1B:
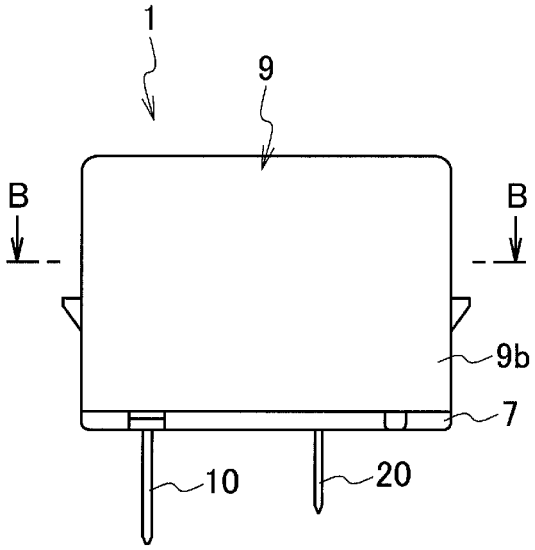
FIG. 1B is a side view.

An embodiment of the present invention is explained in detail below with reference to the drawings. First, a schematic configuration of a contact device 1 according to the embodiment of the present invention is explained with reference to FIG. 1 to FIG. 3.

The contact device 1 according to the present embodiment is applied to an electromagnetic relay. The contact device 1 includes a drive member 2 located on the rear side (on the right) in FIG. 2A and FIG. 2B, and a contact member 3 located on the front side (on the left) in FIG. 2A and FIG. 2B. The drive member 2 and the contact member 3 are housed in a case.

Figure 3:
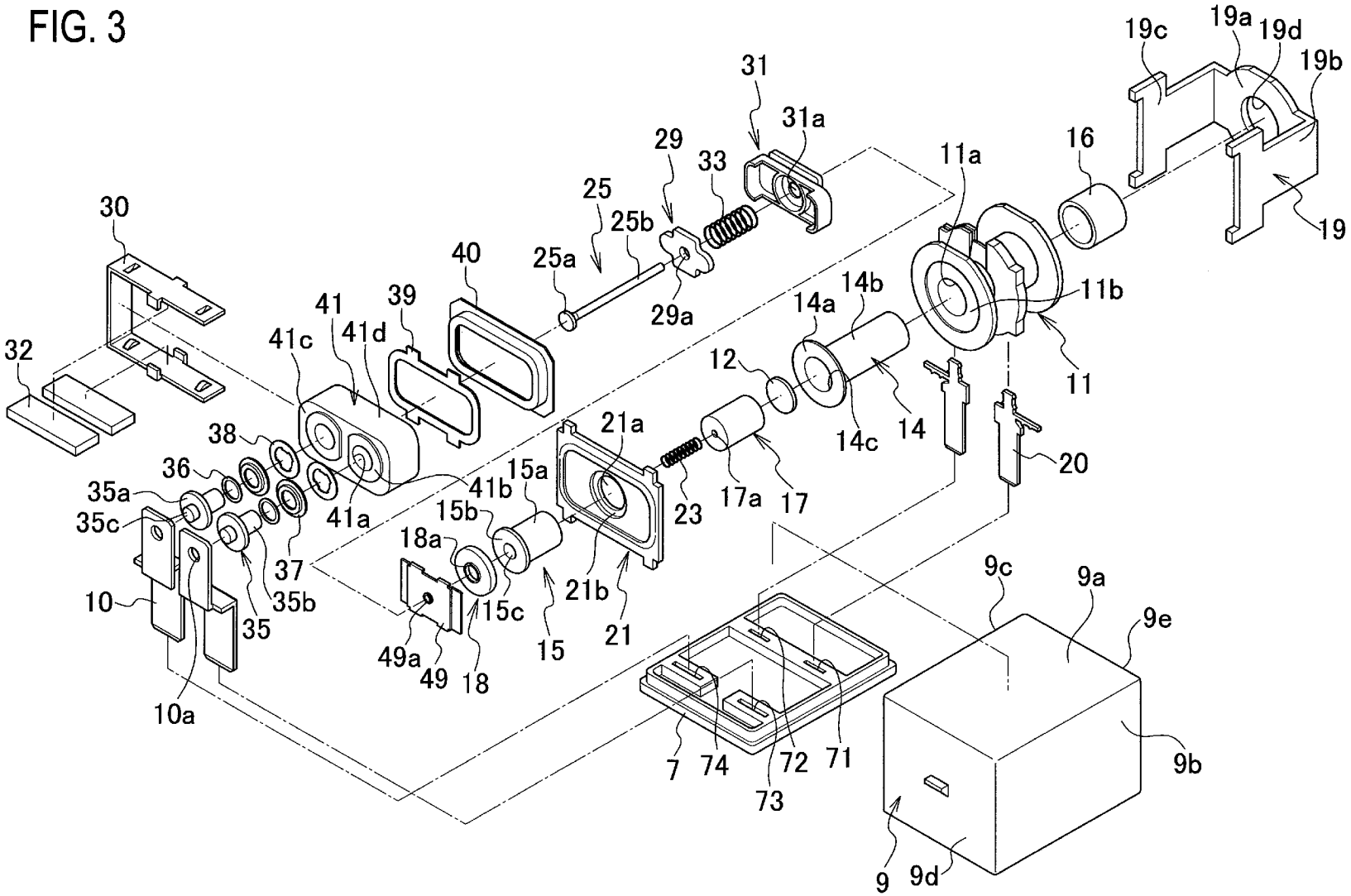
FIG. 3 is an exploded perspective view of a contact device according to an embodiment of the present invention.

The case includes a case base portion 7 formed into substantially a rectangular shape, and a case cover 9 provided over the case base portion 7 that houses installed members such as the drive member 2 and the contact member 3. As shown in FIG. 3, the case base portion 7 is provided (on the rear side) with a pair of slits 71 and 72 in which coil terminals 20 are inserted from above, and provided (on the front side) with a pair of slits 73 and 74 in which main terminals 10 are inserted from above. The case cover 9 has an upper wall member 9*a*, a left wall member 9*b*, a right wall member 9*c*, a front wall member 9*d* and a rear wall member 9*e*. The bottom of the case cover 9 (on the case base member 7 side) is open such that the case cover 9 is formed into a hollow box.

The drive member 2 includes a coil 13 wound on a coil bobbin 11. The coil bobbin 11 is provided with a through-hole 11*a* in the middle, into which a plunger cap 14 is placed. The coil bobbin 11 is provided with a circular mounting surface 11*b* on the front side (on the front wall member 9*d* side) on which a flange 14*a* of the plunger cap 14 is placed. A projection 14*b* of the plunger cap 14 is inserted in the through-hole 11*a*. The coil terminals 20 are connected to the coil 13 wound on the coil bobbin 11 via a lead wire (not shown in the figure).

The plunger cap 14 is provided with a through-hole 14*c* in the middle in which a fixed iron core 15 as a fixed member is placed on the front side and a movable iron core 17 as a movable member is placed on the rear side (on the rear wall member 9*e* side). A rubber cushion 12 is placed on the rear side of the movable iron core 17.

A yoke 19 is provided between the coil 13 and the rear wall member 9*e*. The yoke 19 includes a base wall 19*a* opposed to the rear wall member 9*e*, and a pair of side walls 19*b* and 19*c* extending from peripheral edges of the base wall 19*a* and surrounding the coil 13 so as to be opposed to the left wall member 9*b* and the right wall member 9*c*, respectively. The base wall 19*a* of the yoke 19 is provided with a circular through-hole 19*d* into which a bush 16 is inserted.

A yoke upper plate 21 is provided on the front side (on the front wall member 9*d* side) of the pair of side walls 19*b* and 19*c* of the yoke 19 in such a manner as to cover the coil 13 wound on the bobbin 11.

The fixed iron core 15 is fixed in such a manner that a protrusion 15*a* is fitted into a through-hole 21*a* of the yoke upper plate 21 and the through-hole 14*c* of the plunger cap 14, and a flange 15*b* is placed on a mounting surface 21*b* formed on the front surface of the yoke upper plate 21. The movable iron core 17 located on the rear side of the fixed iron core 15 is placed in such a manner as to freely come close to and separate from the fixed iron core 15 within the through-hole 14*c* of the plunger cap 14.

The fixed iron core 15 and the movable iron core 17 are each provided with a through-hole 15*c* and a through-hole 17*a*, and a return spring 23 is placed between the fixed iron core 15 and the movable iron core 17. The return spring 23 pushes the movable iron core 17 in the separating direction from the fixed iron core 15 (toward the right in FIG. 2 and FIG. 3).

One end of the return spring 23 on the front side comes into contact with a support plate 49 fixed to the front surface of the yoke upper plate 21. A rubber cushion 18 is placed between the support plate 49 and the fixed iron core 15. An insulating plate 31 is provided on the front side of the support plate 49, and a pressure contact spring 33 is placed between the insulating plate 31 and a movable contact member 29 described below.

A shaft 25 is placed in the movable iron core 17 and extends in the moving direction of the movable iron core 17. The movable contact member 29 is attached to one end of the shaft 25 on the front side. The movable contact member 29 is provided with movable contact points 29*b* (refer to FIG. 2), which freely come into contact with and separate from fixed contact points 35*d* of fixed terminals 35 described below.

In the present embodiment, a flange 25*a* is formed at one end of the shaft 25 on the front side, and a screw thread 25*b* is formed at the other end of the shaft 25 on the rear side. The movable contact member 29, the insulating plate 31, the support plate 49 and the rubber cushion 18 are provided with a through-hole 29*a*, a through-hole 31*a*, a through-hole 49*a* and a through-hole 18*a*, respectively, through which the shaft 25 is inserted.

The movable contact member 29 is fixed to one end of the shaft 25 as follows.

First, as shown in FIG. 3, the movable iron core 17, the return spring 23, the rubber cushion 18, the support plate 49, the insulating plate 31, the pressure contact spring 33 and the movable contact member 29 are positioned in this order from the back. The return spring 23 is inserted through the through-hole 15*c* of the fixed iron core 15 in the state in which the protrusion 15*a* is fitted into the through-hole 21*a* of the yoke upper plate 21 and the through-hole 14*c* of the plunger cap 14.

The other end of the shaft 25 is inserted through the respective through-holes 29*a*, 31*a*, 49*a* and 18*a*, the pressure spring 33 and the return spring 23 from the front of the movable contact member 29, and is connected to the movable iron core 17 by the screw thread 25.

Accordingly, the movable contact member 29 is fixed to one end of the shaft 25.

The pair of fixed terminals 35 provided with the fixed contact points 35*d* is placed on the front side of the movable contact member 29 in such a manner as to be opposed to the movable contact points 29*b* provided on both sides of the movable contact member 29 in the longitudinal direction (in the direction from right to left of the case cover 9).

The respective fixed terminals 35 are inserted through through-holes 41*a* provided in a base 41, so that the fixed contact points 35*d* provided on the rear side of the fixed terminals 35 project toward the movable contact points 29*b* of the movable contact member 29. That is, each fixed terminal 35 has a flange 35*a* at one end on the front side and a protrusion 35*b* at the other end on the rear side. The flange 35*a* is placed on a mounting surface 41*b* formed on the front side of the base 41, and the protrusion 35*b* is inserted through the through-hole 41*a*.

Once the fixed contact points 35*d* come into contact with the movable contact points 29*b*, the fixed contact points 35*d* and the movable contact points 29*b* are electrically connected to each other. Here, the pressure contact spring 33 presses the movable contact member 29 so that the respective contact points 29*b* come into contact with the fixed contact points 35*d* at predetermined contact pressure. The pressure contact spring 33 has a spring load set at a lower level than that of the return spring 23. Therefore, in the state in which electrical current is not supplied to the coil 13 and a drive force is not applied to the movable iron core 17, the movable iron core 17 moves together with the movable contact member 29 in the separating direction from the fixed iron core 15 and results in the state shown in FIG. 2A and FIG. 2B since the return spring 23 has a stronger elastic force than that of the pressure contact spring 33.

Each of circular fixing frames 37 is placed between the flange 35*a* of the fixed terminal 35 and the mounting surface 41*b* of the base 41. The flange 35*a*, the fixing frame 37 and the mounting surface 41*b* are fixed together by welding via a first silver solder 36 and a second silver solder 38.

A projection 35*c* is provided on the front side of each flange 35*a*. The projection 35*c* is fitted into a through-hole 10*a* of each main terminal 10 so that the fixed terminal 35 is attached to the main terminal 10.

The base 41 has a base wall 41*c* provided with a pair of through-holes 41*a* thereon, and a cylindrical part 41*d* extending from the peripheral edge of the base wall 41*c*. The base 41 is formed into a hollow box in which the rear side on the movable contact member 29 side is open.

The base 41 is fixed to the yoke upper plate 21 via a rectangular frame 40 while housing the movable contact member 29 inside the cylindrical part 41*d* from the open rear side. The base 41 and the rectangular frame 40 are fixed together by welding via a third silver solder 39.

A capsule yoke 30 formed into substantially a U-shape and equipped with permanent magnets 32 is placed on the periphery of the cylindrical part 41*d* of the base 41 so that the capsule yoke 30 is opposed to the movable contact member 29. An arc, which is generated when the movable contact points 29*b* of the movable contact member 29 come into contact with and separate from the fixed contact points 35*d* of the fixed terminals 35, can be extended due to the permanent magnets 32.

The following is an explanation of the action in the contact device 1.

Figure 2A:
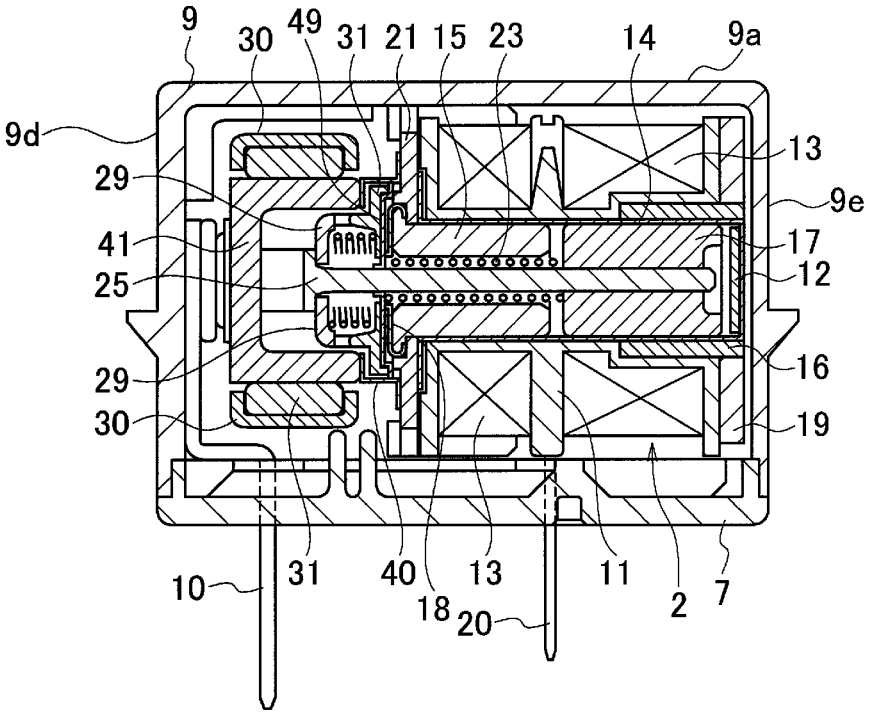
FIG. 2A is a cross-sectional view along the line A-A in FIG. 1A.
Figure 2B:
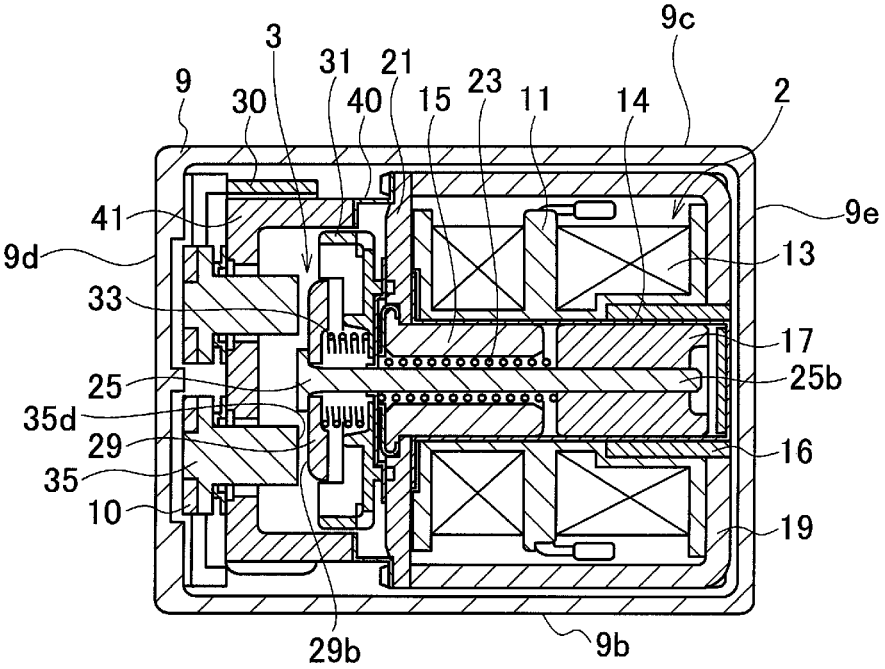
FIG. 2B is a cross-sectional view along the line B-B in FIG. 1B.

First, in the state in which electrical current is not supplied to the coil 13, the movable iron core 17 moves in the separating direction from the fixed iron core 15 since the elastic force of the return spring 23 is stronger than that of the pressure contact spring 33. Therefore, the movable contact points 29*b* are separated from the fixed contact points 35*d* as shown in FIG. 2A and FIG. 2B.

Once the coil 13 is supplied with electrical current, the movable iron core 17 is drawn toward the fixed iron core 15 by an electromagnetic force against the elastic force of the return spring 23 and comes closer to the fixed iron core 15. Then, the movable contact points 29*b* of the movable contact member 29 come into contact with the fixed contact points 35*d* of the fixed terminals 35, so that the respective contact points are electrically connected to each other and the contact device 1 is thus turned on.

Figure 4:
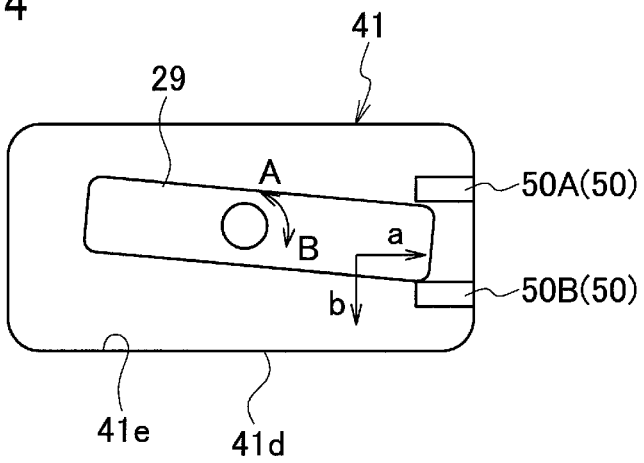
FIG. 4 is an explanatory view showing a main part of a contact device according to an embodiment of the present invention.

FIG. 4 is an explanatory view showing a main part of the contact device 1 according to the present embodiment. As shown in FIG. 4, the movable contact member 29 is housed inside the cylindrical part 41*d* of the base 41 in such a manner as to be freely movable relative to the fixed terminals 35.

The movable contact member 29 is in contact with the pressure contact spring 33. If the pressure contact spring 33 is stretched out to move the movable contact member 29 toward the fixed terminals 35, the movable contact member 29 is rotated by the torque of the pressure contact spring 33 acting in the direction opposite to the winding direction thereof. If the pressure contact spring 33 is retracted to move the movable contact member 29 away from the fixed terminals 35, the movable contact member 29 is rotated by the torque of the pressure contact spring 33 acting in the same direction as the winding direction thereof.

Once the movable contact member 29 is moved and rotated as described above, the movable contact member 29 makes a sliding movement on one long side of the inner wall surface 41*e* of the base 41 in the state in which pressure in the rotating direction is applied to two diagonal points in the short sides on both ends of the movable contact member 29 in the longitudinal direction "a". The sliding movement causes an increase in friction force and as a result, a smooth movement of the movable contact member 29 is possibly hindered.

In view of this, according to the present embodiment, a rotation stopper 50 for regulating the rotation of the movable contact member 29 is provided between the movable contact member 29 and the base 41, and is formed separately from the movable contact member 29.

In particular, as shown in FIG. 4, the rotation stopper 50 according to the present embodiment is a protrusion projecting toward the movable contact member 29 from the inner wall surface 41*e* of the base 41. In the present embodiment, two (plural) projecting rotation stoppers 50 are used. One is provided as a first protrusion 50A for regulating the rotation movement of the movable contact member 29 in the A direction, and the other is provided as a second protrusion 50B for regulating the rotation movement of the movable contact member 29 in the B direction.

Due to the two protrusions 50A and 50B provided as the rotation stoppers 50 in the present embodiment, the rotation movement of the movable contact member 29 in either direction (for example, in the A direction) can be regulated by either one of the rotation stoppers 50 (the first protrusion 50A).

The rotation stoppers 50 in the present embodiment are provided on one short side of the inner wall surface 41*e* of the base 41 opposed to the short side of the movable contact member 29. In particular, in the present embodiment, the first and second protrusions 50A and 50B are located parallel to each other on one short side of the inner wall surface 41*e*. Therefore, the protrusions 50A and 50B provided on one short side project parallel to each other toward the other short side of the inner wall surface 41*e*. One of the short sides of the movable contact member 29 in the longitudinal direction "a" is positioned between the first protrusion 50A and the second protrusion 50B parallel to each other in such a manner as to be interposed therebetween.

In the present embodiment, at least one short side of the movable contact member 29 in the longitudinal direction "a" is inserted between the first protrusion 50A and the second protrusion 50B. Accordingly, when the movable contact member 29 rotates, the protrusions 50A and 50B as the rotation stoppers 50 come into contact with the corners of the movable contact member 29 and regulate the rotation of the movable contact member 29.

As described above, according to the present embodiment, the rotation stoppers 50 for regulating the rotation of the movable contact member 29 are provided between the movable contact member 29 and the base 41, and are formed separately from the movable contact member 29. Therefore, the base 41 can be enlarged compared with conventional cases since it is not necessary to bring the movable contact member 29 into contact with the inner wall surface 41*e* of the base 41 to regulate the rotation of the movable contact member 29. Further, since the rotation of the movable contact member 29 can be regulated even if the base 41 is enlarged, the space for the arc can be expanded sufficiently not only in the longitudinal direction "a" but also in the width direction "b" of the movable contact member 29 (in the vertical direction of the case cover 9). As a result, the arc generated when the movable contact points 29*b* and the fixed contact points 35*d* come into contact with and separate from each other, can be extended also in the width direction "b" of the movable contact member 29 and accordingly, an arc extinction capacity (an arc interruption capacity) can be increased.

At least one of the pair of (plural) rotation stoppers 50 (the first protrusion 50A) regulates the rotation movement of the movable contact member 29 in one direction (for example, in the A direction). Therefore, it is possible to reduce a friction force between the movable contact member 29 and the rotation stoppers 50 and achieve a smooth movement of the movable contact member 29.

According to the present embodiment, the arc can be interrupted more reliably and at the same time, a friction force by the movable contact member 29 caused at the point of sliding can be reduced. Thus, the reliability of the contact points (the reliability of contact and separation between the movable contact points 29*b* and the fixed contact points 35*d*) can be enhanced.

In the present embodiment, the protrusion 50A (50B) projecting from the inner wall surface 41*e* of the base serves as the rotation stopper 50. Therefore, it is possible to prevent the movable contact member 29 from coming into contact with portions of the inner wall surface 41*e* other than the protrusion 50A (50B), and to easily form the rotation stopper 50 by integrating with the base 41. Note that, in the present embodiment, the base 41 and the protrusion 50A (50B) are preferably integrally-molded by use of an insulating material such as synthetic resin.

Further, in the present embodiment, the rotation stopper 50 is provided on one short side of the inner wall surface 41*e* of the base 41 opposed to the short side of the movable contact member 29. This configuration contributes to regulating and reducing the rotation level of the movable contact member 29, compared with the configuration in which the rotation stopper 50 is provided on one long side of the inner wall surface 41 of the base 41 opposed to the long side of the movable contact member 29. As a result, a pressure applied to the rotation stopper 50 by the movable contact member 29 can be decreased, and a friction force between the movable contact member 29 and the rotation stopper 50 can be reduced. In the configuration in which the rotation stopper 50 is provided on the short side of the inner wall surface 41*e* of the base 41, the movable contact member 29 does not come into contact with a corner of the rotation stopper 50 when the rotation of the movable contact member 29 is regulated. This configuration also contributes to preventing the rotation stopper 50 from being scraped. Accordingly, a defect of electrical connection between the contact points caused by deposition of crushed dust can be prevented.

Next, modified examples of a rotation stopping structure (the rotation stopper 50) according to the present embodiment are explained below with reference to FIG. 5 to FIG. 10.

Figure 5:
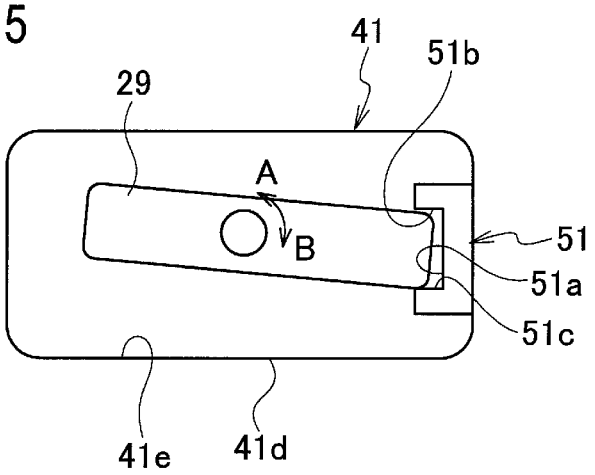
FIG. 5 is an explanatory view showing a main part of a contact device according to a first modified example.

FIG. 5 shows a rotation stopping structure according to a first modified example. This modified example is different from the present embodiment described above mainly in that a rotation stopper 51 is composed of one member, and the rotation stopper 51 includes a first contact surface 51*b* that regulates the rotation movement of the movable contact member 29 in the A direction, and a second contact surface 51*c* that regulates the rotation movement of the movable contact member 29 in the B direction.

In particular, the rotation stopper 51 of this modified example is formed separately from the base 41, and fixed to the inner wall surface 41*e* of the base 41. The rotation stopper 51 attached to the base 41 is provided with a concave portion 51*a* recessed in the direction away from the movable contact member 29. One end of the movable contact member 29 in the longitudinal direction "a" is inserted in the concave portion 51*a*. When the movable contact member 29 rotates, a pair of side wall surfaces in the concave portion 51*a* function as the first contact surface 51*b* and the second contact surface 51*c*, respectively.

In this modified example, whether the movable contact member 29 rotates in a clockwise direction or in a counterclockwise direction, any one of the contact surfaces (the first contact surface 51*b*) can regulate the rotation movement of the movable contact member 29 in one direction (for example, in the A direction).

The above-described configuration of this modified example can also obtain the same effects as the embodiment described above.

According to this modified example, the rotation stopper 51 is composed of one member, and the rotation stopper 51 includes the first contact surface 51*b* that regulates the rotation movement of the movable contact member 29 in the A direction (in one direction), and the second contact surface 51*c* that regulates the rotation movement of the movable contact member 29 in the B direction (in the other direction). Therefore, any one of the contact surfaces (the first contact surface 51*b*) can regulate the rotation movement of the movable contact member 29 in one direction (for example, in the A direction), and a friction force between the movable contact member 29 and the rotation stopper 51 can be reduced.

Figure 6:
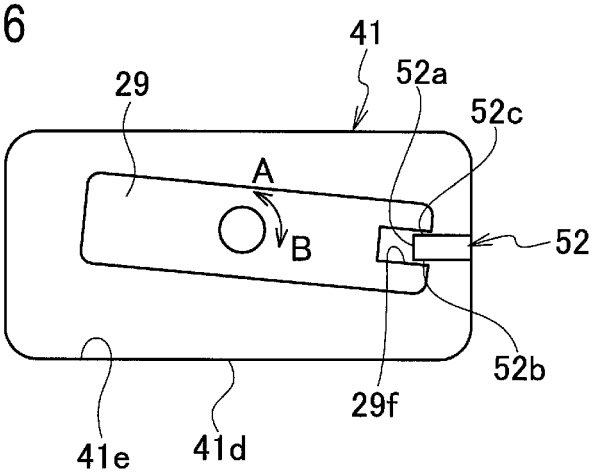
FIG. 6 is an explanatory view showing a main part of a contact device according to a second modified example.

FIG. 6 shows a rotation stopping structure according to a second modified example. This modified example is different from the first modified example described above mainly in that the movable contact member 29 is provided with a concave portion 29*f* in which a rotation stopper 52 is inserted.

In particular, the rotation stopper 52 of this modified example is composed of one rectangular protrusion. This protrusion is formed on and integrated with the inner wall surface 41*e* of the base 41, or provided on the inner wall surface 41*e* as a member separate from the base 41. The concave portion 29*f* is formed on one short side of the movable contact member 29 in the longitudinal direction "a" opposed to the rotation stopper 52. A tip portion 52*a* of the rotation stopper 52 is inserted in the concave portion 29*f*.

The above-described configuration of this modified example can also obtain the same effects as the embodiment and the first modified example described above.

That is, a first contact surface 52*b* can regulate the rotation movement of the movable contact member 29 in the A direction (in one direction) and a second contact surface 52*c* can regulate the rotation movement of the movable contact member 29 in the B direction (in the other direction).

Figure 7:
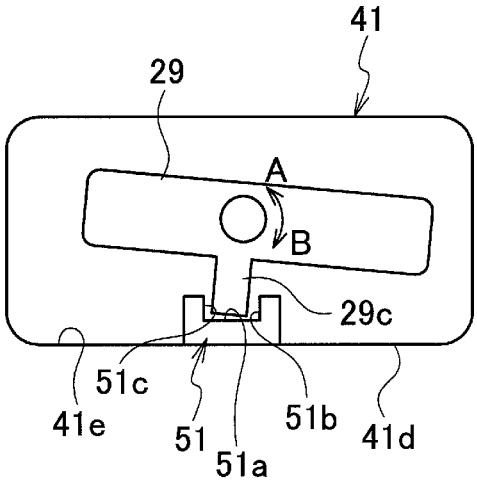
FIG. 7 is an explanatory view showing a main part of a contact device according to a third modified example.

FIG. 7 shows a rotation stopper structure according to a third modified example. This modified example is different from the first modified example described above mainly in that the rotation stopper 51 having the concave portion 51*a* is provided on one long side of the inner wall surface 41*e* of the base 41 opposed to the long side of the movable contact member 29, and the movable contact member 29 is provided with a convex portion 29*c* on the long side that is inserted in the opening of the concave portion 51*a*.

The above-described configuration of this modified example can also obtain the same effects as the embodiment and the first and second modified examples described above.

That is, the first contact surface 51*b* can regulate the rotation movement of the movable contact member 29 in the A direction (in one direction) and the second contact surface 51*c* can regulate the rotation movement of the movable contact member 29 in the B direction (in the other direction).

Figure 8:
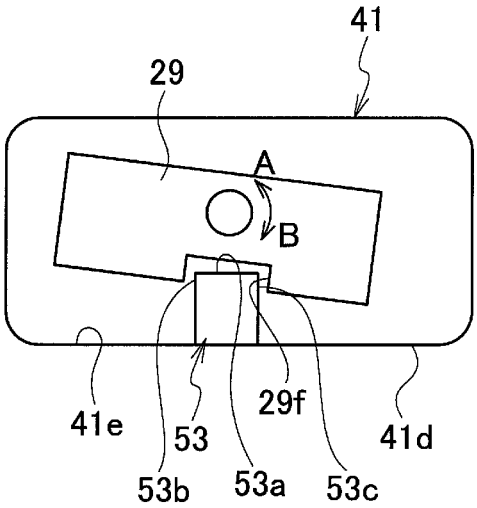
FIG. 8 is an explanatory view showing a main part of a contact device according to a fourth modified example.

FIG. 8 shows a rotation stopper structure according to a fourth modified example. This modified example is different from the second modified example described above mainly in that a rotation stopper 53 is provided on one long side of the inner wall surface 41*e* of the base 41 opposed to the long side of the movable contact member 29, and the movable contact member 29 is provided with the concave portion 29*f* on the long side in which the rotation stopper 53 is inserted.

The above-described configuration of this modified example can also obtain the same effects as the embodiment and the first to third modified examples described above.

That is, a first contact surface 53*b* can regulate the rotation movement of the movable contact member 29 in the A direction (in one direction) and a second contact surface 53*c* can regulate the rotation movement of the movable contact member 29 in the B direction (in the other direction).

Figure 9:
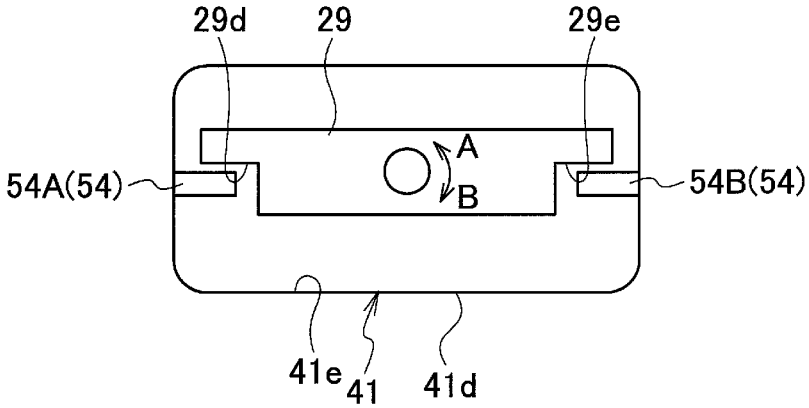
FIG. 9 is an explanatory view showing a main part of a contact device according to a fifth modified example.

FIG. 9 shows a rotation stopper structure according to a fifth modified example. This modified example is different from the embodiment described above mainly in that two (plural) protrusions are formed as rotation stoppers 54, and the rotation stoppers 54 of the two protrusions are provided on each short side of the inner wall surface 41*e*. One of the protrusions functions as a first protrusion 54A that regulates the rotation movement of the movable contact member 29 in the A direction, and the other protrusion functions as a second protrusion 54B that regulates the rotation movement of the movable contact member 29 in the B direction.

According to this modified example, the movable contact member 29 is provided with a pair of concave surfaces 29*d* and 29*e* on each side in the longitudinal direction "a" that are recessed in substantially an L-shape. Each of protrusions 54A and 54B projects toward and overlaps the concave surfaces 29*d* and 29*e*, respectively.

The above-described configuration of this modified example can also obtain the same effects as the embodiment described above.

That is, whether the movable contact member 29 rotates in a clockwise direction or in a counterclockwise direction, any one of the rotation stoppers 54 (the first protrusion 54A) can regulate the rotation movement of the movable contact member 29 in one direction (for example, in the A direction).

Figure 10:
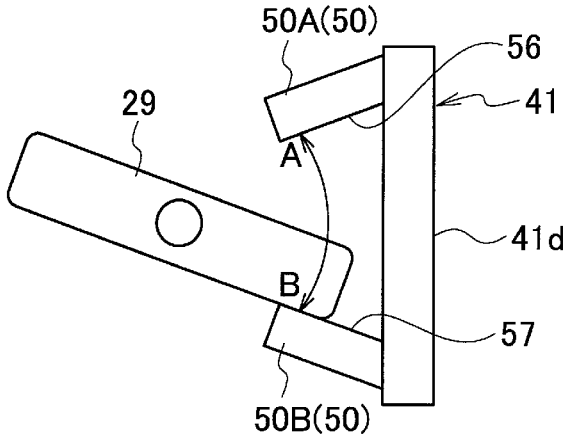
FIG. 10 is an explanatory view showing a main part of a contact device according to a sixth modified example.

FIG. 10 shows a rotation stopper structure according to a sixth modified example. This modified example is different from the embodiment described above mainly in that a contact surface 56 (57) of the rotation stopper 50 with the movable contact member 29 is provided perpendicular to the rotating direction of the movable contact member 29.

In particular, the rotation stoppers 50 are composed of two (plural) protrusions as in the case of the embodiment described above, and are provided to be opposed to each other on one short side of the inner wall surface 41*e*. One of the protrusions functions as the first protrusion 50A that regulates the rotation movement of the movable contact member 29 in the A direction, and the other protrusion functions as the second protrusion 50B that regulates the rotation movement of the movable contact member 29 in the B direction. The contact surfaces 56 and 57 in both protrusions are provided perpendicular to the rotating direction of the movable contact member 29.

The above-described configuration of this modified example can also obtain the same effects as the embodiment described above.

According to this modified example, the contact surface 56 (57) of the rotation stopper 50 with the movable contact member 29 is provided perpendicular to the rotating direction of the movable contact member 29. Therefore, the movable contact member 29 can come into line contact with the contact surface 56 (57) of the rotation stopper 50 and thereby move more smoothly. Namely, in the embodiment described above, one end of the movable contact member 29 in the longitudinal direction "a" comes into contact with the contact surface at an acute angle. As a result, the contact surface of the rotation stopper 50 with the movable contact member 29 may be scraped in association with the sliding action of the movable contact member 29. In addition, one end of the movable contact member 29 in the longitudinal direction "a" may be stuck in the roughened surface. However, according to this modified example, since the movable contact member 29 can come into line contact with the contact surface 56 (57) of the rotation stopper 50, it is possible to prevent the movable contact member 29 from being stuck in the contact surface and thereby further enhance the reliability of a switching action between the contact points.

Although the present invention has been described above by reference to the preferred embodiment, the present invention is not limited to the description thereof, and it will be apparent to a person skilled in the art that various modifications and improvements can be made within the scope of the present invention.

For example, in the sixth modified example, the contact surface perpendicular to the rotating direction of the movable contact member as a characteristic part was applied to the respective rotation stoppers (a pair of protrusions) in the embodiment described above. However, the contact surface may be applied to one rotation stopper according to the first to fifth modified examples.

In addition, the movable terminals, the fixed terminals, and other specifications (such as shape, size and layout) may be modified as appropriate.

What is claimed is:

1. A contact device comprising:

a base;

a pair of fixed terminals placed on the base in such a manner as to partially protrude inside the base, respectively;

a movable contact member stored inside the base, the movable contact member being opposed to the pair of fixed terminals and being freely movable relative to the pair of fixed terminals;

a shaft provided with the movable contact member fixed to one end thereof, the shaft extending in a moving direction of the movable contact member; and at least one rotation stopper formed separately from the movable contact member and provided between the movable contact member and the base so as to regulate a rotation of the movable contact member about the shaft, the at least one rotation stopper regulating a movement in one rotating direction of the movable contact member by contact with an edge of a long side of the movable contact member, wherein the movable contact member is movable between a position where the movable contact member is in direct contact with the pair of fixed terminals and a position where the movable contact member is not in contact with the pair of fixed terminals, and the rotation stopper is a protrusion that projects inwardly from an inner wall surface of the base in the direction of the movable contact member.

2. The contact device according to claim 1, wherein the rotation stopper is composed of one member and includes a first contact surface that regulates the movement in one rotating direction of the movable contact member, and a second contact surface that regulates a movement in another rotating direction of the movable contact member.

3. The contact device according to claim 1, wherein the rotation stopper is provided on a short side of the inner wall surface of the base opposed to a short side of the movable contact member.

4. The contact device according to claim 1, wherein a contact surface of the rotation stopper with the movable contact member is provided perpendicular to the rotating direction of the movable contact member.

5. The contact device according to claim 2, wherein the rotation stopper is provided on a short side of the inner wall surface of the base opposed to a short side of the movable contact member.

6. The contact device according to claim 2, wherein a contact surface of the rotation stopper with the movable contact member is provided perpendicular to the rotating direction of the movable contact member.

7. The contact device according to claim 3, wherein the rotation stopper is provided on only one surface of the short side of the inner wall surface of the base.

8. The contact device according to claim 5, wherein the rotation stopper is provided on only one surface of the short side of the inner wall surface of the base.

9. The contact device according to claim 1, further comprising:

a pressure contact spring in direct contact with the movable contact member and configured to move the movable contact member toward the pair of fixed terminals by stretching of the pressure contact spring, the movable contact member being rotated by a torque of the pressure contact spring.

10. The contact device according to claim 1, wherein the shaft extends fully through the movable contact member.

11. The contact device according to claim 1, wherein the base surrounds the movable contact member such that no inner wall of the base contacts the movable contact member, and the protrusion extends inwardly from the inner wall surface such that the length of the protrusion is greater than a distance between the inner wall and a short side of the movable contact member adjacent the inner wall.

* * * * *